US006281475B2

(12) United States Patent
Campbell et al.

(10) Patent No.: US 6,281,475 B2
(45) Date of Patent: Aug. 28, 2001

(54) PIPE STAND INSTRUMENT HEATER AND MOUNTING SYSTEM

(75) Inventors: Bryan J. Campbell; Roy E. Barth, both of San Marcos; W. Gregory Huff, Fischer; Ronald W. Zaborowski, New Braunfels; Charles M. Bonorden, New Braunfels; David L. Schlameus, New Braunfels, all of TX (US)

(73) Assignee: Thermon Manufacturing Company, San Marcos, TX (US)

( * ) Notice: Subject to any disclaimer, the term of this patent is extended or adjusted under 35 U.S.C. 154(b) by 0 days.

(21) Appl. No.: 09/759,306

(22) Filed: Jan. 12, 2001

Related U.S. Application Data

(62) Division of application No. 09/316,907, filed on May 21, 1999, now Pat. No. 6,196,297.
(60) Provisional application No. 60/086,200, filed on May 21, 1998.

(51) Int. Cl.[7] ..... H05B 3/00; H05B 3/06
(52) U.S. Cl. ..... 219/385; 219/521; 219/201; 165/47; 248/121; 432/266; 73/431
(58) Field of Search ..... 219/521, 385, 219/200, 201, 505, 549; 392/484, 494; 165/47; 248/121; 432/266; 73/431; 137/340–341; 338/214

(56) References Cited

U.S. PATENT DOCUMENTS

| | | | | |
|---|---|---|---|---|
| 993,178 | * | 5/1911 | Lamont | 219/201 |
| 1,009,549 | * | 11/1911 | Moss | 219/521 |
| 1,508,799 | * | 9/1924 | Klett | 219/521 |
| 1,652,487 | * | 4/1927 | Meyer | 219/521 |
| 2,045,466 | * | 6/1936 | Hellbach | 219/521 |
| 2,098,735 | * | 11/1937 | Yentis | 219/521 |
| 2,313,015 | * | 3/1943 | Hesse | 219/521 |
| 2,432,868 | * | 12/1947 | Earl | 219/521 |
| 2,555,416 | * | 6/1951 | Marano | 219/521 |
| 2,708,796 | * | 5/1955 | Adamy | 219/521 |
| 3,430,032 | * | 2/1969 | Morey | 219/521 |
| 3,436,171 | * | 4/1969 | Weichselbaum et al. | 219/521 |
| 3,705,974 | * | 12/1972 | Nilsson | 219/385 |
| 4,107,513 | * | 8/1978 | Ashford | 219/521 |
| 4,319,492 | * | 3/1982 | Hewson et al. | 73/756 |
| 4,529,865 | * | 7/1985 | Oakes, Jr. | 219/521 |
| 5,229,580 | * | 7/1993 | Chioniere | 219/521 |
| 5,306,896 | * | 4/1994 | Glater et al. | 219/521 |
| 6,196,297 | * | 3/2001 | Campbell et al. | 165/47 |

FOREIGN PATENT DOCUMENTS

| | | | | |
|---|---|---|---|---|
| 847985 | * | 10/1939 | (FR) | 219/521 |
| 107250 | * | 4/1943 | (SE) | 219/385 |

* cited by examiner

*Primary Examiner*—John A. Jeffery
(74) *Attorney, Agent, or Firm*—Akin, Gump, Strauss, Hauer & Feld, L.L.P.

(57) ABSTRACT

A pipe stand instrument heater system for heating an instrument within an enclosure supported by a pipe stand. The heater system includes a housing mounted to the pipe stand and a heater unit in the housing. A bracket is provided for mounting the instrument to the housing. The heater unit can be powered by electric, steam or other fluids.

14 Claims, 5 Drawing Sheets

FIG. 3
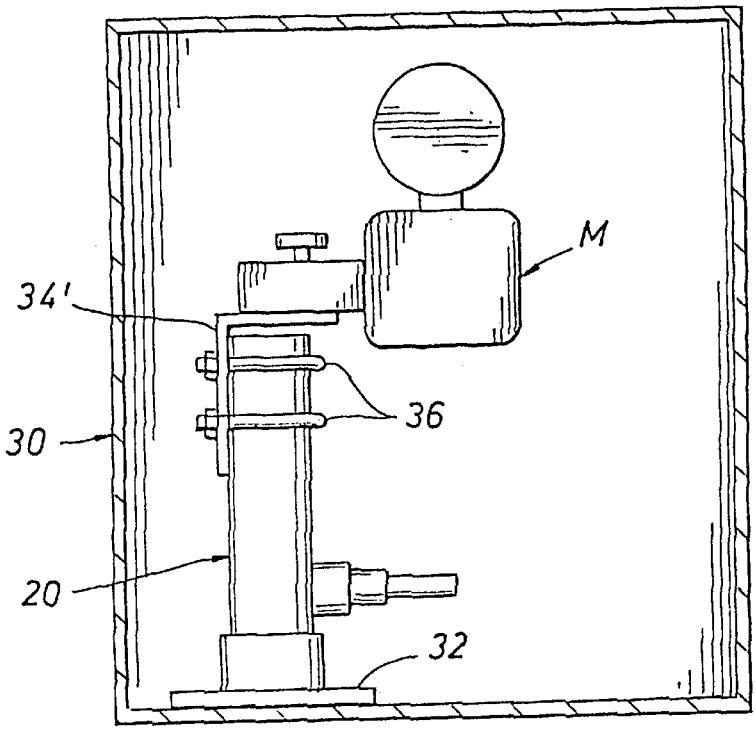
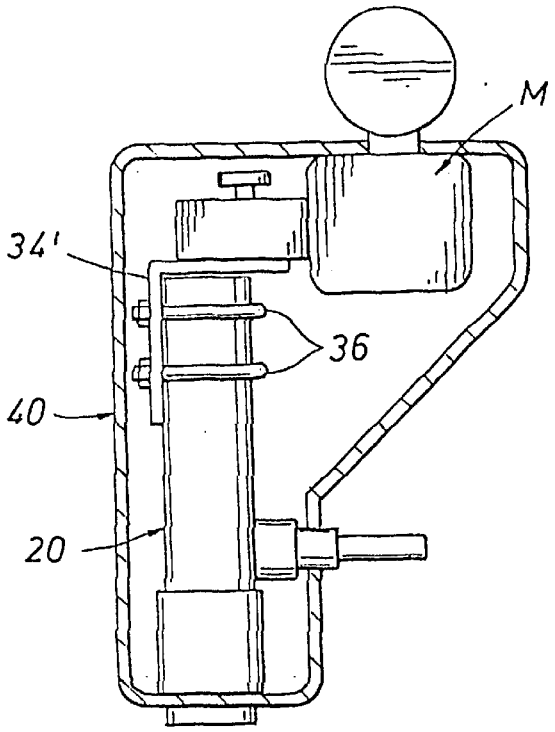
FIG. 4

FIG. 7
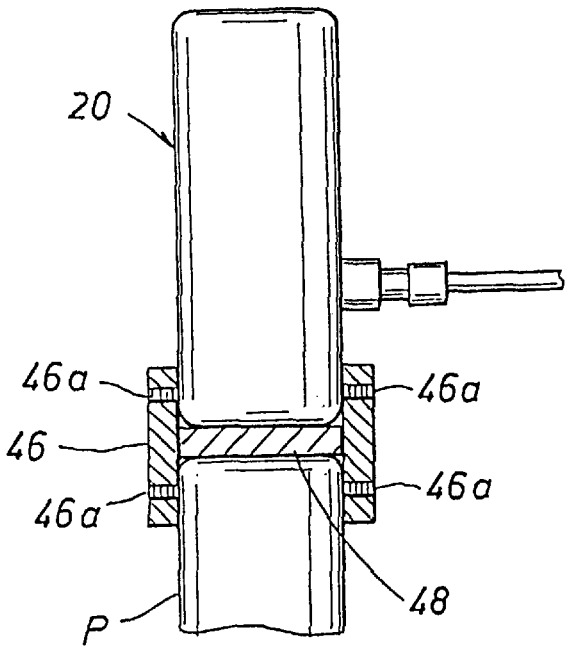
FIG. 8A
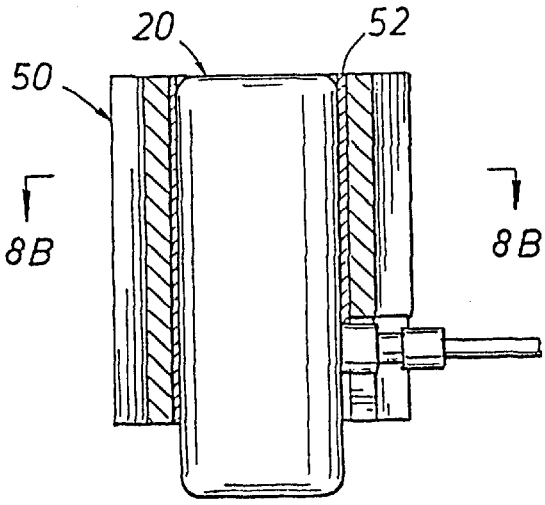
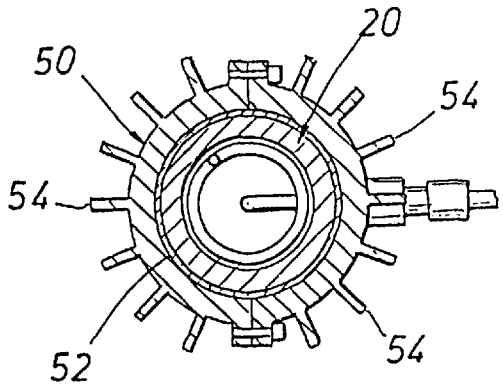
FIG. 8B

PIPE STAND INSTRUMENT HEATER AND MOUNTING SYSTEM

CROSS-REFERENCE TO RELATED APPLICATIONS

This application is a Divisional of U.S. patent application Ser. No. 09/316,907 filed May 21, 1999, now U.S. Pat. No. 6,196,297 and claims benefit of U.S. Provisional Patent Application Ser. No. 60/086,200 having a filing date of May 21, 1998.

STATEMENT REGARDING FEDERALLY SPONSORED RESEARCH

Not applicable.

BACKGROUND OF THE INVENTION

1. Field of the Invention

The present invention relates generally to instrument heaters, and more particularly relates to instrument heaters for pipe stand-mounted industrial instruments.

2. Description of the Related Art

Commonly, industrial instruments are mounted to a pipe stand having a diameter of approximately two inches. The instruments are generally mounted to the pipe stand with a pair of U-bolts. In many environments it is necessary to provide a heated enclosure for the instruments. Two categories of enclosures are typically used. The first type is a hard case or box-like structure which is usually hinged or provided with quick release latches to access the instrument contained within the hard case. The second type of enclosure is a soft flexible case that is fitted around the instrument.

Typically, in the past an instrument heater was mounted in close proximity to the instrument and the enclosure necessarily was required to have enough inside space to accommodate both the heater and the instrument. Conventional instrument/manifold/enclosure heaters utilize predominantly convection heat transfer in warming the air around the instrument and manifold within an instrument manifold/enclosure. Heretofore, all heaters for instrument/manifold/enclosures have been separate add-ons to the pipe/instrument/support system. Prior art heaters take up additional valuable space around the instrument, necessitate careful engineering to ensure fit, and require larger instrument/manifold/enclosures which necessarily result in greater heat loss.

In certain instances it is necessary to repair or service the instrument. Typically, in these instances the heater is required to be detached or removed from the instrument in order for the repairs or servicing of the instrument to be conducted. From a safety standpoint, the mounted heater within the enclosure can burn or injure a person performing maintenance or adjusting the instrument within the enclosure.

It is desirable to have a pipe stand instrument heater that minimizes the required space within the instrument enclosure. It is further desirable to have a pipe stand instrument heater that minimizes any complications with respect to servicing or repairing the instrument. It is also desirable that the pipe stand instrument heater be suited for use with both hard case and soft case enclosures. It is also desirable that the pipe stand instrument heater provide a safe working environment and be adapted for use with either steam, fluid or electricity.

SUMMARY OF THE INVENTION

The present invention is an instrument heater and mounting system that minimizes the required space within the instrument enclosure and also minimizes any complications with respect to servicing or repairing the instrument. The instrument heater and mounting system is suited for use with both hard case and soft case enclosures and provides a safe working environment.

The instrument heater includes a housing and a heater unit included within the housing. A bracket mounts to the housing and supports the instrument. The present invention provides a system for heating an instrument or a manifold within an enclosure mounted to a pipe stand with either steam, fluid or electricity.

The pipe stand instrument heater system allows substantially increased heat transfer by pipe stand conduction. The present invention internally warms the instrument pipe support and thus utilizes heat conduction from the pipe to the instrument/manifold/bracket to reduce the power requirements necessary to maintain the equivalent desired temperature using a conventional convection heat transfer heater.

The instrument heater can include a non-thermally conductive outer coating to minimize heat conduction (and reduces burn potential) in the event of inadvertent touching of the unit during service.

BRIEF DESCRIPTION OF THE DRAWINGS

The objects, advantages, and features of the invention will become more apparent by reference to the drawings which are appended hereto and wherein like numerals indicate like parts and wherein an illustrated embodiment of the invention is shown, in which:

FIG. 3 is an elevational view illustrating a typical installation of the pipe stand instrument heater of FIG. 1 within a hard case enclosure using a manifold mount arrangement;

FIG. 4 is an elevational view illustrating a typical installation of the pipe stand instrument heater of FIG. 1 within a soft case enclosure using a manifold mount arrangement;

FIG. 7 is an elevational view in partial section illustrating the pipe stand instrument heater of FIG. 1 adapted to the top of the pipe stand;

FIG. 8A is an elevational view in partial section of the pipe stand instrument heater of FIG. 1 converted into a convection heater;

FIG. 8B is a view taken along line 8B—8B of FIG. 8A;

DETAILED DESCRIPTION OF INVENTION

In the prior art, a hard case enclosure for mounting instruments within included a 2" mounting post, typically extending vertically from the bottom of the hard case enclosure. The instrument or manifold was typically mounted to the mounting post with U-bolts. The prior art instrument heater was mounted to the instrument or manifold, walls of the enclosure or to the exterior of the mounting post.

Figure 1:
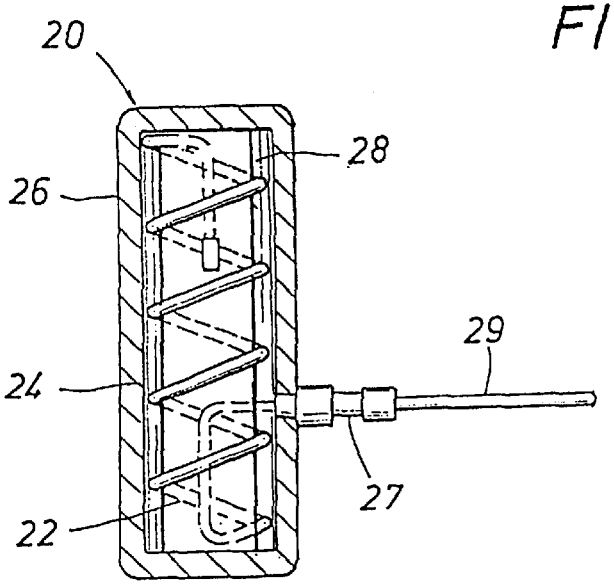
FIG. 1 is an elevational view in partial section of a first embodiment of a pipe stand instrument heater according to the present invention, the instrument heater using electricity.

The pipe stand instrument heater according to a first embodiment of the present invention, generally designated as 20, is shown in FIG. 1. The pipe stand instrument heater 20 includes a core 22 comprising a spiraled coil installation of a self-regulating heater cable 24 within a pipe housing 26, preferably cylindrical in shape and having closed ends. Preferably, the pipe housing 26 is made from 2" Nominal Pipe Size ("NPS") or a casting the same size as 2" NPS. The self-regulating heater cable 24 preferably includes a high temperature conductive polymer based cable. One type of suitable conductive polymer, self-regulating heater cable is manufactured by assignee Thermon Manufacturing Company of San Marcos, Texas, under the trademark VSX. It is to be understood that there are other heater cable products available that are suitable for use in the present invention.

Preferably, a sleeve spring 28 is inserted within the spiraled coil installation of the self-regulating heater cable 24 in the pipe housing 26 to ensure thermal contact of the heater cable 24 to the pipe housing 26. This results in minimal or no loss of internal heat transfer coefficient as the heater cable 24 warms (and the self-regulating cable polymer materials' natural spring constant reduces).

Preferably, the instrument heater 20 is a self-regulating heater. Self-regulating heaters are known in the art. Self-regulating heaters are preferred because they will not burn out from accidental overheating and are also energy saving. A conventional self-regulating heat tracing cable may be utilized in a coil fashion within the explosion-proof metallic housing 26 and may deliver temperature varying heat outputs ranging from 0 to 1000 watts by varying the heater element power characteristics or the size and length of the pipe housing 26. Conventional instrument/manifold/enclosure heaters have fixed power levels between 0 to 200 watts and are not easily power adjustable.

The self-regulating heater cable 24 may comprise an integrally extruded fluoropolymer-based conductive core and external insulating layer with either 14 American Wire Gauge ("AWG") or smaller bus wire construction which can deliver power densities from 20 to 50 watts per foot of cable, and even as low as 5 watts per foot of cable, while configured in coil bend radii ranging from 1 3/16" down to 3/8". This construction has been found to be preferred, and perhaps necessary, to deliver high wattage power from within the 2" pipe housing 26. It is to be understood that in low heat delivery applications, other types of lower output self-regulating heater constructions may be used.

Referring to FIG. 1, the heater cable 24 exits the pipe housing 26, preferably through the side wall of the pipe housing 26. Preferably, a suitable sealed cable connection 27 exists outside the pipe housing 26 for connecting the heater cable 24 to a supply line 29.

The self-regulating instrument heater 20 can also utilize a self-regulating heater cable 24 without a grounding braid in electrically classified areas such as Class 1 Div 2, Class 1 Div. 1, and Zone 1. A conventional braided heater in this arrangement will result in reduced heat transfer efficiency due to the air gaps (contact resistances) which result between the braid and the internal pipe housing 26.

Figure 2:
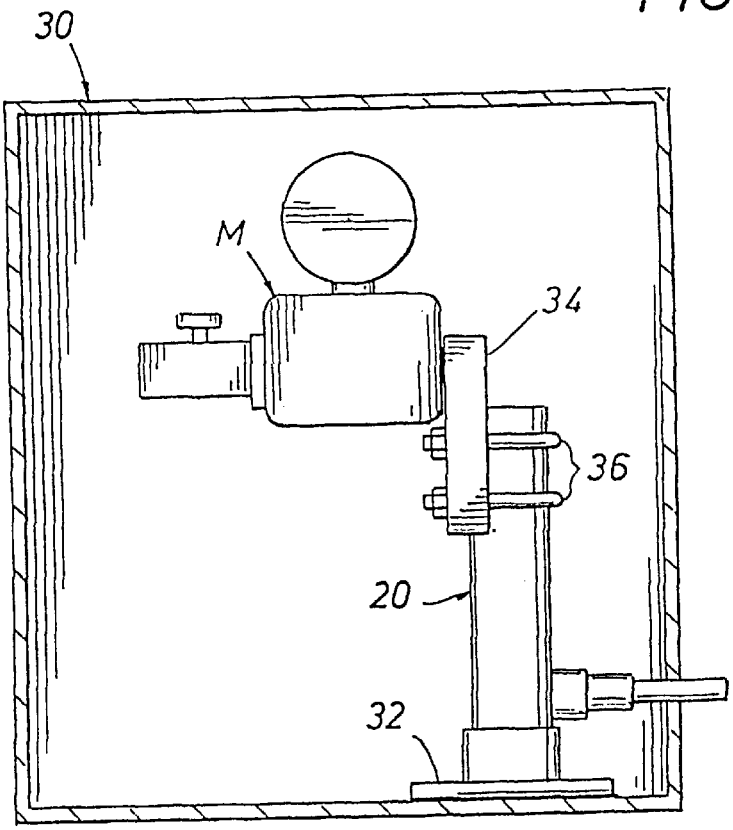
FIG. 2 is an elevational view illustrating a typical installation of the pipe stand instrument heater of FIG. 1 within a hard case enclosure using a pedestal mounting plate.

Referring to FIG. 2, the pipe stand heater 20 is shown installed in a hard case enclosure 30. The hard case enclosure 30 is a box-like structure typically having hinges or quick release latches (not shown) to access the instrument and manifold M contained within the hard case enclosure 30. One face of the hard case enclosure 30, typically the bottom face, includes a pedestal mounting plate 32. Preferably, the pipe housing 26 of the pipe stand heater 20 is mounted directly to the pedestal mounting plate 32. It is important to understand that the pipe stand heater 20 replaces the conventional 2" mounting post in the typical hard case enclosure. The instrument and manifold M is mounted to the pipe stand heater 20 with a bracket 34 and a pair of U-bolts 36, as shown in FIG. 2. Preferably, the instrument and manifold M is directly connected to the pipe stand heater 20 with the bracket 34 and the pair of U-bolts 36.

It is to be understood that the above-described manner of mounting the instrument and manifold M within the hard case enclosure 30 is the same manner as has been used in the past with the only difference being that the instrument heater 20 has replaced the conventional 2" mounting post in the typical hard case enclosure.

As shown in FIG. 3, the instrument and manifold M may also be mounted to the instrument heater 20 within the hard case enclosure 30 using a manifold mount arrangement.

Once again, it is important to understand that the instrument heater 20 replaces the conventional 2" mounting post in the typical hard case enclosure. The manifold mount bracket 34' is preferably directly connected to the instrument heater 20 with a pair of U-bolts 36. Thus, the instrument and manifold M is mounted within the hard case enclosure 30 in the same manner as in the past. The only difference is that the instrument heater 20 has replaced the conventional 2" mounting post within the hard case enclosure 30.

The pipe stand instrument heater 20 is also ideal for use with a soft case enclosure 40 as shown in FIG. 4. Referring to FIG. 4, the pipe housing 26 of the instrument heater 20 is mounted to a pipe stand P. Similar to that described above with respect to the hard case enclosure 30, the instrument heater 20 replaces a conventional 2" mounting post which typically extends through the lower end of the soft case enclosure 40. The soft case enclosure 40 typically includes an opening for the pipe stand P and a hook and loop closure (not shown) allowing access within the soft case enclosure 40. The soft case enclosure 40 shown in FIG. 4 also includes an opening for the instrument gauge. It is to be understood that the construction and configuration of the hard and soft case enclosures 30 and 40, respectively, are shown merely by way of example and are not limited to the configurations shown in the figures.

FIG. 4 shows a typical installation of the pipe stand instrument heater 20 of FIG. 1 within the soft case enclosure 40 using the manifold mount arrangement. As described above, the manifold mount bracket 34' is preferably directly connected to the instrument heater 20 with a pair of U-bolts 36. Thus, the instrument and manifold M is mounted in the same manner as in the past and the soft case enclosure 40 fits over the instrument and manifold M. The only difference is that the instrument heater 20 has replaced the conventional 2" mounting post.

Figure 5:
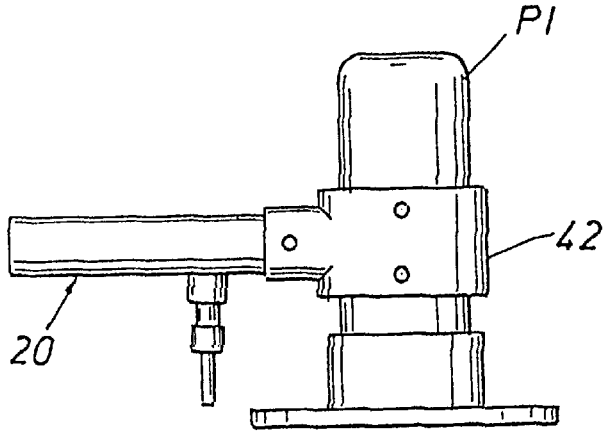
FIG. 5 is an elevational view illustrating an installation of the pipe stand instrument heater of FIG. 1 in a hard case enclosure in a retrofit application using a cross mount bracket arrangement.

The instrument heater 20 of the present invention can also be used in retrofit applications. In a retrofit application, one may either replace the existing pipe stand with the instrument heater 20 or use a cross mount bracket arrangement to mount the instrument heater 20 as shown in FIG. 5. Referring to FIG. 5, the first embodiment of the pipe stand instrument heater 20 is installed in a hard case enclosure (not shown) in a retrofit application using a cross mount bracket arrangement. A 2" tee pipe adapter 42 is mounted on the existing field pipe stand P1 and the instrument heater 20 is mounted to the 2" tee pipe adapter 42.

Figure 6:
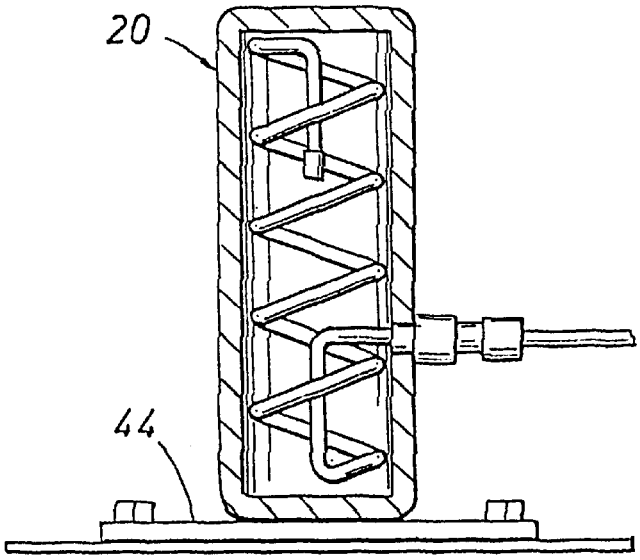
FIG. 6 is an elevational view in partial section illustrating the pipe stand instrument heater of FIG. 1 supplied with an integral pedestal.

Alternatively, the pipe stand instrument heater 20 can be supplied with an integral pedestal plate assembly 44 as shown in FIG. 6. Another alternative is to adapt the mounting of the pipe stand instrument heater 20 to the top of the pipe stand P as shown in FIG. 7. Referring to FIG. 7, a coupling 46 extends partially onto the upper end of the existing pipe stand P and is secured to it, preferably with set screws 46a. The instrument heater 20 is inserted into the upper portion of the coupling 46 and secured to it, preferably with set screws 46a. Preferably, an insulative barrier 48 is positioned between the pipe stand P and the instrument heater 20. The coupling 46 can be made from various materials, including stainless steel which is a relatively low thermal conductivity material as compared to steel. The insulative barrier 48 can be made from various thermally insulative materials, including marinite, ceramics, and plastics such as Nylon. The instrument heater 20 may be converted into a convection heater by adding external heat sinks. Referring to FIGS. 8A and 8B, one such external heat sink is shown as a heat sink clamshell assembly 50 mounted around the pipe housing 26 of the instrument heater 20. Preferably, a heat conductive gasket or thermally conductive paste 52 is situated between the instrument heater pipe housing 26 and the heat sink clamshell assembly 50. The heat sink clamshell assembly 50 includes a plurality of external fins 54 which provide additional surface area to facilitate additional heat output. As shown in FIG. 8B, the clamshell assembly 50 can be formed in a pair of sections and connected to each other around the pipe housing 26.

One of the serious concerns of users has always been safety. The instrument heater 20 with external fins 54 as shown in FIGS. 8A and 8B tend to reduce the "touch temperatures" experienced by users. If desirable, a thin thermally non-conductive coating can be applied to these units to provide even greater protection from the hot surface contact by the user.

Figure 9:
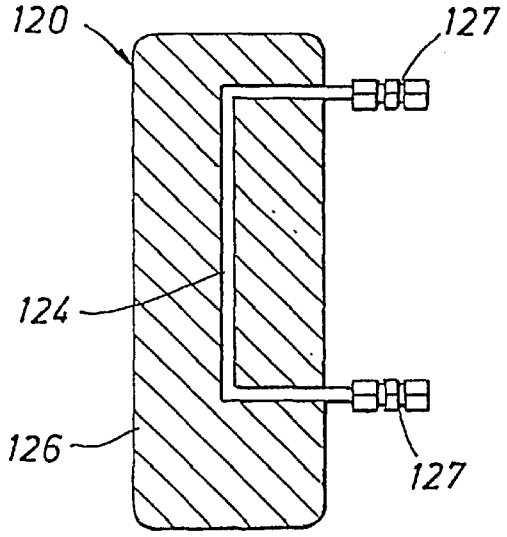
FIG. 9 is an elevational view in section of a second embodiment of the pipe stand instrument heater using steam.
Figure 10:
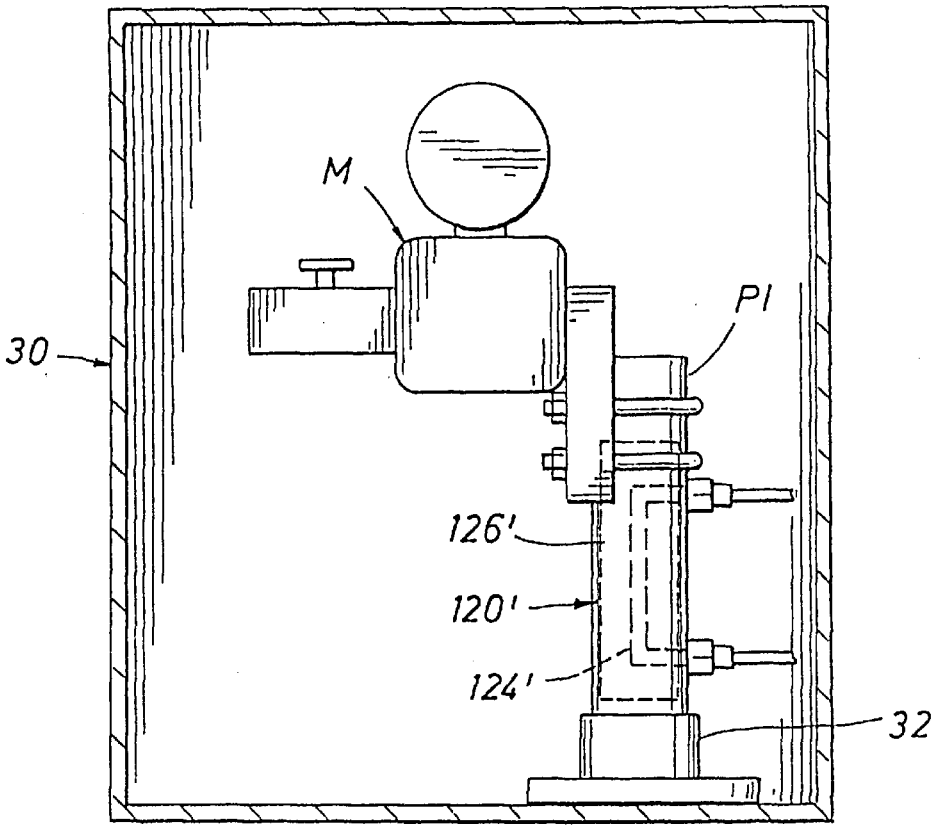
FIG. 10 is an elevational view illustrating a typical installation of the pipe stand instrument heater of FIG. 9 within a hard case enclosure.

Another embodiment of the pipe stand instrument heater, designated generally as 120, is shown in FIGS. 9 and 10. The instrument heater 120 uses steam as the heat source. The internal heater cable 24 from the first embodiment is replaced with a tube loop 124 which is contained within a housing 126, preferably cylindrical in cross section. The tube 124 preferably has a diameter of approximately ¼" or ⅜". Preferably, the tube loop 124 is made from stainless steel. The tube loop 124 may be cast into an aluminum or steel pipe stand/heat sink housing 126 as shown in FIG. 9. Alternatively, the housing 126 may be formed with an elongated recess in the side of the housing 126 for receiving the tube loop 124. After the tube loop 124 is inserted in the housing recess, the remainder of the recess is filled with thermally conductive potting compound and a cap is placed over the filled recess.

Preferably, the tube 124 has no internal connection within the heater 120 to minimize leak potential with time. The high temperature steam tube 124 is also somewhat buffered from the user by the housing 126 and can be additionally buffered by an outer nonmetallic coating to allow greater burn protection. Attachment of the steam heater 120 to field steam is effected by using unions127, preferably compression type stainless steel unions.

The installation of the steam heater 120 and the mounting of the instrument and manifold M can be accomplished as described above for the instrument heater 20. For example, the steam heater 120 can be mounted to the hard case enclosure 30 with the pedestal mounting plate 32. It is also to be understood that the pedestal mounting plate 32 can be an integral assembly with the housing 26, 126 or can be a separable assembly which secures the instrument heater 20, 120 with securing means, for example threaded fasteners or set screws (not shown).

An alternative embodiment of the steam heater, referred to as 120', is shown in FIG. 10. The pipe stand instrument heater 120' includes a capsule 126' which slips inside a pipe stand P1. Preferably, the capsule 126' is a bronze or stainless steel machined capsule which slips inside the pipe stand P1. With reference to FIG. 10, the capsule 126' has an internal tube loop 124' with internal female threaded end portions to allow the capsule 126' to be inserted into the pipe stand P1. Preferably, the internal tube loop 124' is a drilled passageway for steam to flow through the capsule 126'. The pipe stand P1 includes a pair of holes which align with the female threaded end portions so that standard compression type male threaded connectors can be mated to the capsule within the pipe stand P1. The pipe stand P1 thus has a replaceable capsule steam/fluid heating capability. This also permits existing pipe stands to be easily retrofitted with the steam heater capsule 126'. The capsule may utilize a conductive sheet or paste to improve fit between the capsule and the inside surface of the pipe stand.

It is to be understood that all previously described features and options for the electric heater unit 20 are equally applicable in the steam heater units 120 and 120'.

The pipe stand instrument heater 20, 120, 120' provides a space efficient means of providing a heater unit to a pipe mounted instrument/manifold M contained within an enclosure 30, 40. The smaller the space of the enclosure, the less volume there is to heat. The pipe stand instrument heater of the present invention provides the dual function of a pipe support and a heater. The present invention provides better heat transfer to the instrument by also utilizing conduction heating. The present invention is especially desirable with soft case enclosures 40. One of the reasons is that conduction heating is much more effective than convection heating in a soft case enclosure 40 which is more susceptible to air movement through and out of the flexible seams in the case.

The foregoing disclosure and description of the invention are illustrative and explanatory thereof, and various changes in the details of the illustrated apparatus and construction and method of operation may be made without departing from the spirit of the invention.

What is claimed is:

1. In a pipe stand instrument heater system of the type having a pipe stand and an industrial instrument to be supported from the pipe stand with a bracket in an enclosure, the improvement comprising:

a heater assembly having a housing of substantially the same diameter of the pipe stand, an electric heater unit included within said housing, and a mount assembly for mounting said housing to the pipe stand, the industrial instrument mounted to the exterior of said housing with the bracket and heated exteriorly of said heater assembly.

2. The heater system of claim 1, wherein said electric heater unit comprises a heater cable.

3. The heater system of claim 2, wherein said heater cable is self-regulating.

4. The heater system of claim 2, wherein said heater cable is installed in said housing in a spiraled coil.

5. The heater system of claim 4, further comprising a sleeve inserted in said housing, said sleeve maintaining said heater cable in thermal contact with said housing.

6. The heater system of claim 2, wherein said heater cable is maintained in thermal contact with said housing.

7. The heater system of claim 2, further comprising a sleeve inserted in said housing, said sleeve maintaining said heater cable in thermal contact with said housing.

8. A pipe stand instrument heater system for heating an industrial instrument within an enclosure supported by a pipe stand, the heater system comprising:

a housing mounted to the pipe stand;

an electric heater unit in said housing; and a bracket attached to the exterior of said housing for mounting the industrial instrument, wherein the industrial instrument is heated exteriorly of said housing.

9. The heater system of claim 8, wherein said electric heater unit comprises a heater cable.

10. The heater system of claim 9, wherein said heater cable is self-regulating.

11. The heater system of claim 10, wherein said heater cable is installed in said housing in a spiraled coil.

12. The heater system of claim 11, further comprising a sleeve inserted in said housing, said sleeve maintaining said heater cable in thermal contact with said housing.

13. The heater system of claim 9, wherein said heater cable is maintained in thermal contact with said housing.

14. The heater system of claim 9, further comprising a sleeve inserted in said housing, said sleeve maintaining said heater cable in thermal contact with said housing.

* * * * *